US005127299A

United States Patent [19]

Stroh et al.

[11] Patent Number: 5,127,299

[45] Date of Patent: Jul. 7, 1992

[54] STRING CLAMPING MECHANISM

[76] Inventors: Paul F. Stroh, 10229 42nd SW., Seattle, Wash. 98146; Dennis R. Gunn, Tokyo 145, Ota-Ku, Yukigaya Otsuka, 1620, Japan

[21] Appl. No.: 610,705

[22] Filed: Nov. 8, 1990

[51] Int. Cl.[5] ..... G10D 3/06

[52] U.S. Cl. ..... 84/314 N; 24/135 R

[58] Field of Search ..... 84/314 N, 314 R, 297 R, 84/304-306, 315-318; 242/149, 150 R, 150 M, 151, 152, 152.1; 248/68.1; 24/135 R, 135 N, 135 A; 174/175

[56] References Cited

U.S. PATENT DOCUMENTS 4,475,432 10/1984 Stroh ..... 84/314 N
4,669,350 6/1987 Gressett, Jr. et al. ..... 84/314 N
4,829,873 5/1989 Suzuki et al. ..... 84/314 N

FOREIGN PATENT DOCUMENTS 890754 2/1944 France ..... 174/175

*Primary Examiner*—L. T. Hix

*Assistant Examiner*—Howard B. Blankenship

[57] ABSTRACT

A clamp is provided at the nut of a guitar for clamping the strings to prevent them from sliding across the nut. The clamp was a boss portion in which a bore is formed. A set screw is provided in one end as a plug. A screw with a handle is threaded into the other end of the bore and six cylindrical spacers are disposed between the plug and the screw with the handle. Slots are cut in the boss which expose the ends of the spacers so that the strings of the guitar can be slid between the ends of the spacers. Tightening the screw with the handle clamps the strings between the spacers. The clamp has a step, formed on one side of it, on which a nut is mounted. The nut is divided into three sections whose heights and orientations are adjustable to suit the camber of the fret board of the guitar and the height of the frets, so as to eliminate the need for shimming or filing the nut. A unique string tree is also provided having six hook shaped slots, on a string bar, which align all of the strings of the guitar while allowing the strings to be inserted from the top without having to be threaded through a small hole.

14 Claims, 7 Drawing Sheets

STRING CLAMPING MECHANISM

BACKGROUND OF THE INVENTION

1. Field of the Invention

The present invention relates to an improved clamping mechanism for clamping the strings of a stringed instrument, such as a guitar. More specifically, the invention relates to a simplified clamping mechanism, wherein the individual strings of the instrument are held between laterally movable blocks, and wherein at least one of the blocks is engaged by an urging means which urges it in the direction of a stationary block, which is arranged on the other side of a string therefrom. The urging means is formed such that it is disposed entirely to one side of the block upon which it acts, so that the need to pass a bolt under the strings of the instrument is avoided, and thickness of the of the portion of the clamping mechanism which extends under the strings of the instrument can be reduced.

2. Description of the Prior Art

Clamping nuts, for preventing the strings of musical instruments, particularly guitars, from slipping across the nut and going out of tune, have become increasingly popular. An excellent example of such a nut is set forth in U.S. Pat. No. 4,475,432 issued Oct. 9, 1984. In this device a plurality of blocks are arranged in a groove in the nut of a guitar, so as to be longitudinally slidable therewithin. The blocks have registered holes aligned along the long axis of the slot in the nut. A bolt is inserted through the registered holes in the blocks, and is threaded into one of the end blocks. The strings of the instrument are arranged in the gaps between the blocks. When the bolt is tightened, the blocks are driven together, and the strings become clamped in the gaps between the blocks.

The above device is extremely convenient because all of the strings of the instrument can be clamped at once by tightening the bolt, and because the strings are arranged to pass over the top of the bolt and therefore don't need to be threaded through a small hole, as in other types of clamping nut devices. Instead, they are slid, from above, into the gaps between the blocks while the bolt is in a loosened state.

The above device however has the following disadvantages. The end block which engages the threads of the bolt, and the other end block, which is engaged by the head of the bolt, tend to twist in the groove due to friction when the bolt is turned. This twisting of the blocks tends to cause the strings of the instrument to go out of tune when the nut is tightened.

The above disadvantages can be avoided by forming the blocks and groove very precisely so as to eliminate any room for play. Achieving this precision tends to make the units expensive to produce.

Solutions to the problems of the spacer rotation and formation of the groove for the spacers were proposed by the authors in U.S. patent application Ser. No. 242,425 wherein it was proposed that the spacer blocks be formed as cylinders having a flat side, or a keyway, to prevent them from rotating, and that the groove be formed as a cylinder with the top portion open.

In the later device however, another disadvantage occuring in all the above devices, remains unresolved. This problem being that the bolt, by which the blocks are driven together, passes through the centers of the blocks, and under the strings at the nut of instrument, with respect to the heal or the headstock. Thus, the effective clamping portion of the blocks, is limited to that space above the top of the bolt, and there is a rather large dead space, in the gaps between the spacers, beneath the effective clamping portions.

The net effect of this is that the portion of the nut lying beneath the level of the lowest string, must be equal to the thickness of the bolt, plus the thickness of the portion of the spacer block lying between the bolt and the lower web of the channel portion of the nut, plus the thickness of the web itself, which must be substantial so as to provide the degree of stiffness required to prevent the sides of the channel portion from spreading. This means that a rather deep groove must be made in the neck of the instrument, to accommodate the nut. Forming this groove requires skilled labor, and it weakens the juncture between the peg head of the instrument an the neck, which can cause it to break more easily if the instrument is accidentally mishandled.

A further problem in the above devices lies in the fact that the center block must be fastened to the channel member in order to prevent the blocks from sliding laterally within the groove. This means that some fastening means such as a threaded hole must be formed in the block. This has the result of adding a production step to the manufacture of the center blocks. This increases the production cost.

SUMMARY OF THE INVENTION

In view of the above problems encountered in the devices formed in accordance with the prior art, one object of the present invention is to provide a clamping nut mechanism which can be produced at a reduced cost.

It is another object of the invention, to provide a clamping nut which can be mounted to the nut of a guitar or other stringed instrument without requiring as much of the material of the nut to be removed as with the clamping nuts according to the prior art.

It is another object of the instant invention to provide nut clamping mechanism in which a central portion of the string can be inserted from above, without being threaded through a small hole, and which can be easily mounted.

It is another object of the instant invention to provide a clamping nut mechanism wherein the tendency is reduced for the strings for go out of tune when the clamp is tightened.

The above objects and others are achieved in a string clamp according to the invention by providing a block member in which a channel is defined for receiving a plurality of spacer blocks. A stop is defined at an end of the channel, and a driving means is defined at a side of one of the spacer blocks, for driving the blocks in the direction of the stop. The driving means does not penetrate the blocks as the bolt does in the above mentioned device. Therefore the dead space at the bottom of the channel can be eliminated, allowing the clamp to be made thinner. In the preferred embodiment the channel takes the form of a cylindrical bore with a threaded portion at each end, and slots are cut into the member in which the bore is formed, penetrating to the bore, so as to facilitate the insertion of the guitar strings into the gaps between the spacers blocks received in the bore. The driving means consists of a screw, threaded into one end of the channel, having a handle by which it can be rotated. Actuation of the handle serves to drive the end block, and through it the blocks and strings in between it and the stop, in the direction of the stop.

In another embodiment stops are provided at both ends of the channel and the driving means is defined by a cam at the center of the blocks. The cam has a handle, provided at the top thereof, which protrudes from the top of the boss, the rotation of the cam, by means of the handle, drives the blocks at the opposite sides thereof in opposite directions, towards the respective stops at the opposite ends of the channel. The stops may be comprised of screws threaded into the ends of the channel.

DETAILED DESCRIPTION OF THE PREFERRED EMBODIMENTS

Figure 1:
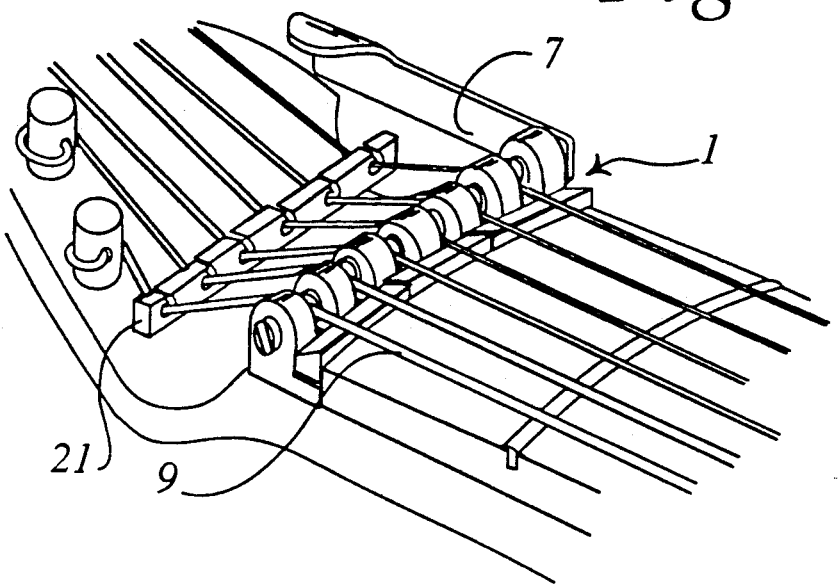
FIG. 1 is a perspective view, depicting a portion of a headstock of a guitar, whereon a string tree and a string clamp according to a first embodiment of the invention are mounted.
Figure 2:
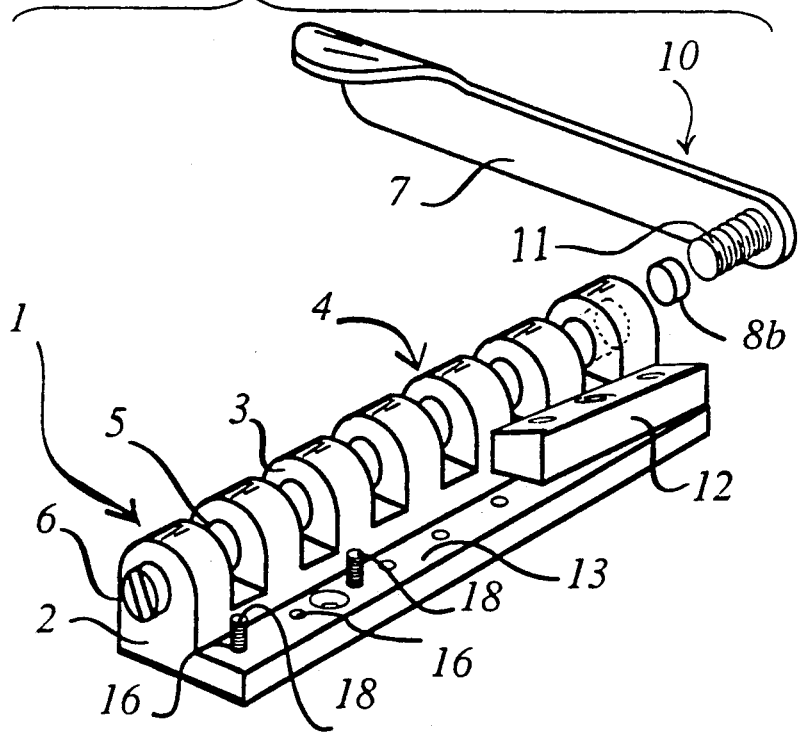
FIG. 2 is an enlarged perspective view showing details of the string clamp according to the first embodiment of the invention.
Figure 3:
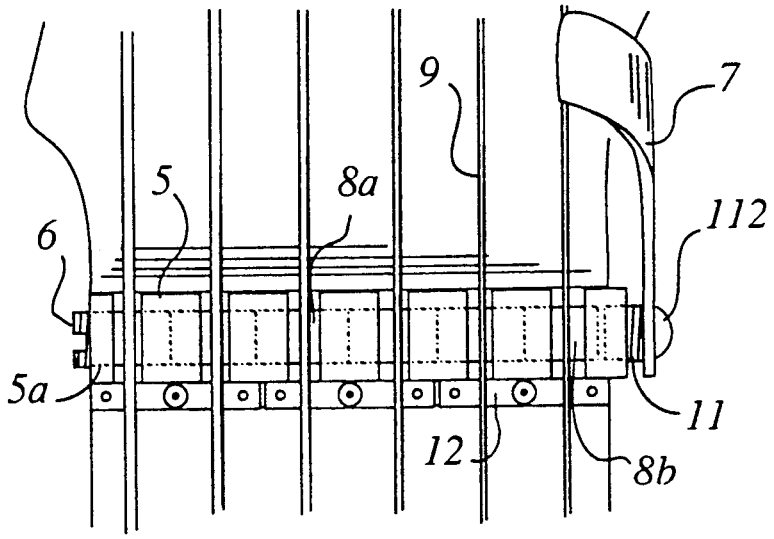
FIG. 3 is a plan view of the clamp according to the first embodiment of the invention.

In FIGS. 1 to 3 a string clamp, generally denoted 1, according to a first embodiment of the invention is depicted. As will be appreciated by those skilled in the art, the string clamp 1 is suited for employment in a guitar, in that it is so configured as to facilitate six strings. It will be appreciated however, that other embodiments are conceivable for use in instruments in which the number of strings are different.

The string clamp 1 is designed to extend, at the position near the base of the head stock that is normally occupied by conventional guitar nuts, with its general axis arranged at right angles to that of the neck of the guitar.

The string clamp 1 comprises a main body 2, at the "head" side of which, a boss portion 4 is defined. The boss portion 4 is formed with six slots 3, whose spacing generally corresponds with that of the strings of the instrument. A cylindrical bore 5 is formed to extend axially through the boss portion 4.

At its end portions, the bore 5 is formed with threaded portions 5*a* and 5*b*. A set screw 6 is threaded into one of the threaded end portions, and a handle assembly comprised of a threaded member bearing a handle, is threaded into the other. In the illustrated example, the handle 7 is provided at the treble side, and the set screw is provided at the bass side, in view of the ergonomics involved in the tightening operation. It will however, be appreciated that the positions, of the handle assembly and the set screw, are basically interchangeable.

Between the threaded end portions 5*a* and 5*b*, the bore 5 is preferably smooth and is not threaded, although this is not a prerequisite to the invention.

Disposed within the bore 5 are six cylindrical spacer members. Five of the cylindrical spacer members 8*a* are of a first length that is equal to the spacing between the strings 9 of the instrument, and the other spacer 8*b* is relatively short. The spacers 8*b* and 8*a*, may be solid or of very thick walled tubing. Preferably the diameter of the spacers 8*a* and 8*b* is as nearly equal to the interior diameter of the bore 5, as is possible, while still allowing them to slide freely therewithin.

So as to avoid wear and scoring, preferably the material of the spacers is harder than that of the strings 9 of the instrument.

As can be seen from FIGS. 1 and 3, with the above arrangement, the slots 3 formed in the boss portion expose the ends of the spacer members 8*a* and 8*b* so that the strings 9 can be arranged to pass through the slots 3 and lay between the facing surfaces of the spacer members.

While the strings are in this state, it will be seen that tightening the handle assembly 10, by rotating the handle 7 in the tightening direction, causes the threaded member 11 to move inwards and urge the treble end spacer 8*b* in the inward direction. As the treble end spacer 8*b* moves inwards, it comes into forcible contact with the first of the strings 9. The lateral force of the screw 11 is transmitted through the first string 9 to the first of the longer spacers 8*a* and, through it, to the next string 9. This process repeats in a chainlike manner, until the sixth string is forcibly urged against the flat face formed on the inner side of the set screw 6, by the last of the long spacers 8*a*. Once this has occurred, further rotation of the handle 7 simply increases the force with which the strings 9 are squeezed between the spacers 8*a* and 8*b*.

In this manner, a value of clamping pressure by which the strings 5 are prevented from slipping between the spacers of the clamp 1 can be obtained, and the tuning of the guitar is in no danger of becoming altered, due to string slippage across the nut.

In the above embodiment, if the strings of the instrument are not centered to the user's satisfaction, with respect to the fretboard, the set screw 6 can be used to center the strings.

For example, if the strings are too close to the treble side of the fret board, the centering screw 6 is loosened, and when the clamping screw 11 is again tightened to the point that the strings cannot move across the nut, the general position of the strings 9 will be closer to the bass side of the neck. Of course when the strings are to be moved in the treble direction, the opposite operation is carried out, wherein the screw 11 is loosened and the set screw 6 is tightened.

It will be noted that the above operation will have the effect of altering the angular position to which operation of the handle 7 will produce a give degree of pressure on the strings 9.

In view of this, it will be noted that this effect may be used specifically for the purpose of adjusting the position of the handle relative the neck of the instrument, when the handle 7 is in the locked position. In cases where this effect is so employed, it will be understood that in order to take best advantage of this effect, without suffering the disadvantage that the position of the strings on the fretboard cannot be finely adjusted, the threads of the set screw 6 should be selected to be as fine as possible since the centering of the blocks will be adjustable in increments equal to the pitch of the screw threads. Alternatively a conventional nut, having grooves for precisely aligning the strings, may be provided in addition to the clamping mechanism according to the invention.

On the other hand, in order to more precisely align the strings by means of the set screw 6, while still obtaining the desired degree of clamping pressure when the handle 7 is at an unobtrusive position, a simple method is to attach the handle 7 to the screw 11, by means of a small screw 112. Preferably, the mating surfaces of the handle 7 and the screw 11 are knurled. With this arrangement, in order to set the position of the handle 7, at which the desired value of clamping pressure is obtained, the user simply tightens the handle to the desired value, while a set of strings of the preferred gage are fitted into the appropriate spaces in the clamp, loosens the screw 112, moves the handle 7 to the desired position then, retightens the screw 112.

A further unique feature of the clamp unit 1 according to the first embodiment of the invention is the adjustable nut portions provided at the fret board side of the clamp unit 1. In the first embodiment the nut is separated into three discreet nut members 12 which are fastened to a step portion 13 formed at the fret board side of the clamp body 2.

The step portion 13 comprises 9 threaded holes formed at right angles to its surface. Six of the threaded holes align with stepped bores 14 formed in the end portions of the nut portions 12, while the other three threaded holes align with countersunk bores formed at the centers of the nut portions 12. The stepped bores comprise a lower large diameter bore **14*b* section and an upper small diameter bore section 14*a* separated by a step transition 14*c***.

In addition to the threaded holes formed in the step 13 at least two countersunk bores 17 are formed in the step for accommodating mounting screws 19 by which the clamp unit 1 is attached to the neck 100 of the instrument.

Height adjuster set screws 18 are threaded into the holes 16 which align with the stepped bores 14 in the ends of the nut portions 12. The tops of the height adjuster set screws abut against the step portions **14*c* of the stepped bores 14. The set screws are formed with hexagonal holes for receiving an Allen wrench which is inserted through the smaller top portion 14*a* of the bore 14. Thus, the height of each of the respective nut portions is adjusted by operation of the height adjuster set screws 18**.

Once the desired height has been obtained the lock screws 20 are tightened, this eliminates vibration of the nut portions and prevents the nut portions from falling off when there are no strings on the instrument on the particular nut portion.

By providing a nut formed in the above manner, the installation of the clamp unit on the guitar is greatly simplified, since no shimming is necessary to adjust the height of the nut as is the conventional practice. What is more, thanks to the fact that the nut is divided into three portions, each supporting only two strings, the crown of the strings is not limited and it is possible to adjust the nut to fit the camber of any fret board.

Figure 4:
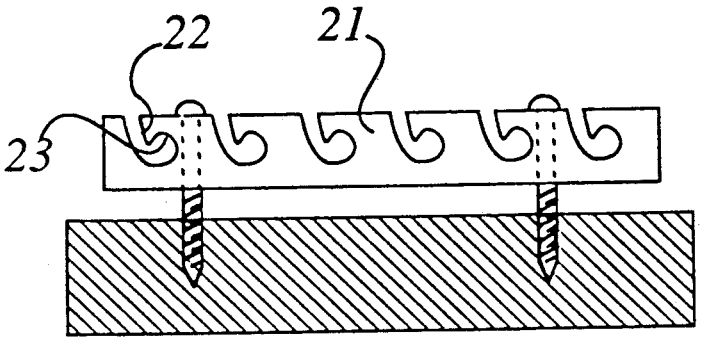
FIG. 4 is a front elevational view showing a string tree according to the invention.
Figure 5:
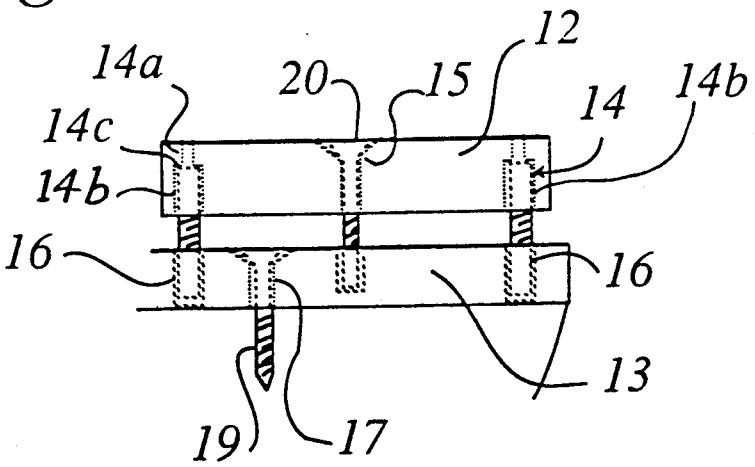
FIG. 5 is a front elevational view a section of the nut and the nut mounting step portion, formed at the front side of the clamp according to the first embodiment of the invention.

A string alignment tree formed 21 according to the invention is depicted in FIG. 4.

The string alignment tree 21 is provided so as to align the strings with the gaps between the nut spacers, in cases where the tuners of the instrument are not aligned with the gaps in the nut to receive the strings.

The string tree formed in accordance with the invention is unique in that, while being formed as a single bar for aligning all of the strings of the instrument, unlike in other bar type alignment posts, a bight section of each of the respective strings can be inserted from above. This eliminates the necessity to thread the strings through a hole in the bar or through the gap defined at the bottom of the bar, between the mounting screws.

This is achieved by forming the bar with a series of boot shaped slots. Each of the slots comprise an inclined slit portion 22, at the end of which, a round string receiving portion 23 is formed. The round string receiving portion 23 is formed such that the top is higher than the portion at which it connects with the slit 22 through which the string 9 may be inserted. When the string is inserted into the guide, tension in the string therefore urges it against the top of string receiving portion 22. The position of the top of the string receiving portion thus determines the angle at which the string enters the gaps in the spacers of the clamp 1.

The string receiving portions are formed to have the same spacing as the gaps between the spacers of the clamp unit 1. Therefore, when the clamp unit 1 is actuated to close, there is no tendency for the strings to be driven sideways and the tendency for the strings to go out of tune when the clamp is tightened, is thus eliminated.

Figure 6:
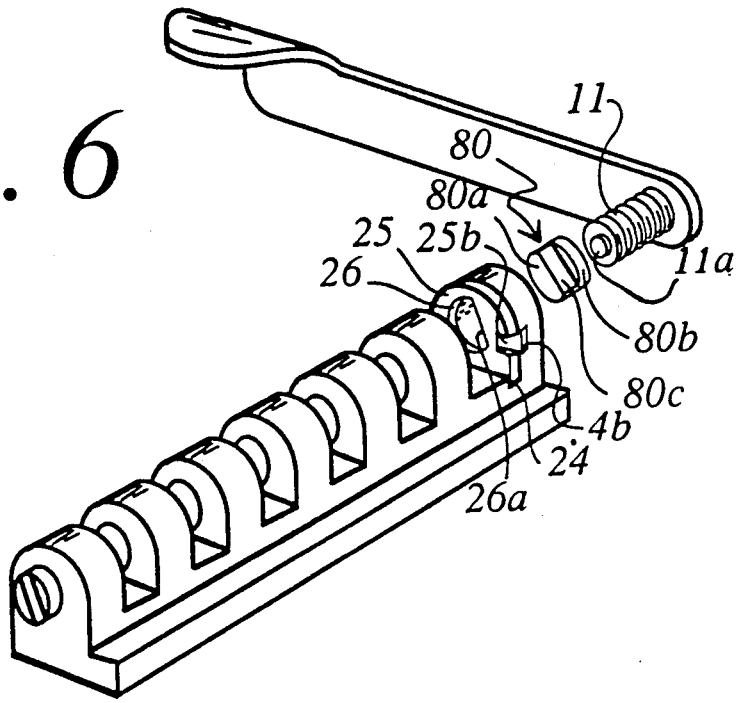
FIG. 6 is an enlarged partial perspective view showing a detail of an end portion of the clamp according to a second embodiment of the invention, whereon retaining means is defined for preventing rotation of one of the spacers.

A detail of a second embodiment of the invention is shown in FIG. 6. In the FIG. 6 embodiment of the invention the clamping unit is identical to the clamping unit of the first embodiments in all respects, except in that a groove 24 is formed at the side of the first groove 3 that is nearest the handle 7. The lower end of a retainer 25 is received in this groove 24.

The retainer 25 is stamped from sheet metal and formed such, that its upper portion has the general profile of the top of the boss portion 4, and the lower portion is flush against the bottom of the groove 24. A hole is stamped through the retainer 25, at a position which precisely registers with the cylindrical bore 5 in which the spacers **8*a* are arranged. The hole 26 defines a circle with one flat side 26*a***.

The first spacer 80, which is driven by the screw 11 for tightening the clamp to close, is a cylinder the same size as the hole 5 with a portion ground away, so as to give the inside end **80*a* the same profile as the hole 26. Thus, as the clamp is tightened, the flat 80*c* formed on the spacer 80, engages the flat 26*a* of the retainer 25. The retainer 25 is prevented from rotating, by its engagement with the flat bottom surface of the groove 24. Thus, the tendency for the rotation of the screw 11 to cause the spacer 80 to rotate, is eliminated. In this manner, the danger of the tuning of the first string 9, which is engaged by the inner end of of the first spacer 80, being altered due to twisting of the spacer 80**, is eliminated.

At the outer end of the spacer 80, a small portion 80*b* is left which defines a complete circle, that is essentially the same diameter as the bore 5 in cross section. This portion 80*b* is optional, and serves to prevent the spacer from sliding too far into the slot 3, and getting to a position where it might fall out, as could otherwise occur when the strings are removed from the guitar, and the spacers 8*a* can all slide towards the bass side of the boss 4.

In the second embodiment of the invention, depicted in FIG. 6, the additional precaution against rotation of the retainer 25, of forming a key tab 25*b* thereon, which fits into a key slot 4*b*, formed in the boss 4, has been taken. With this arrangement, even if the retainer does not fit precisely flush against the bottom of the slot 24, the rotation of the retainer 25 is still prevented by the engagement between the key tab 25*b* and the key slot 4*b*.

As a further precaution against rotation of the first spacer 80, the end of the screw 11 has a small diameter inner end portion 11*a*. The small diameter inner end portion 11*a* engages the outer end of the spacer 80 and, due to its reduced diameter, it has a reduced mechanical advantage for turning the spacer synchronously with the rotation of the screw 11.

Although in the above embodiment, three different precautionary measures are taken against rotation of the spacer, it will be understood that any one of them could be used alone or with only one of the other precautionary measures.

Figure 7:
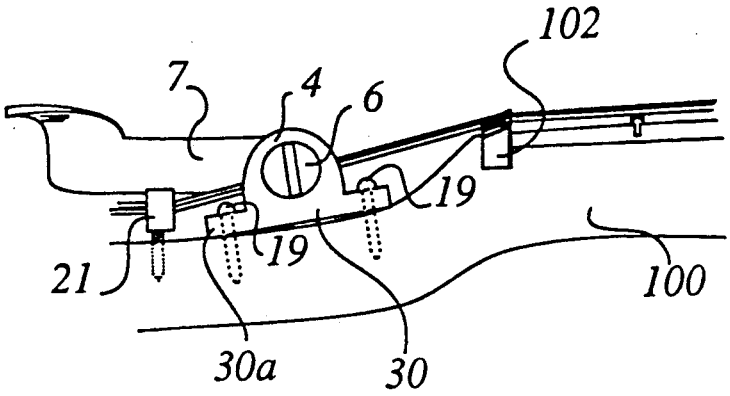
FIG. 7 is a side elevation view of a clamp according to a third embodiment of the invention.

In a third embodiment of the invention shown in FIG. 7 the clamp is in all respects, similar to that of the first embodiment except for the fact that it does not include step portion 13, for mounting the nut portions 12. Instead the main body 30 of the clamp according to the third embodiment comprises mounting flanges 30*a* protruding to the front and rear, in which holes are formed to accommodate mounting screws 19, by which it is attached to the portion at the base of the headstock 101, of a guitar having a conventional non locking nut 102.

The mounting flanges 30*a*, at the front and rear sides of the main body 30 of the clamp, provide a wide support base so there is no tendency for the clamp to twist about the base on the surface of the guitar.

Thus the only modifications to the guitar that are necessary in order to accommodate the clamp according to the third embodiment, are the holes for the mounting screws. This embodiment is therefore extremely easy to install on guitars having no extra space formed in the nut groove for an oversized nut assembly.

Figure 8:
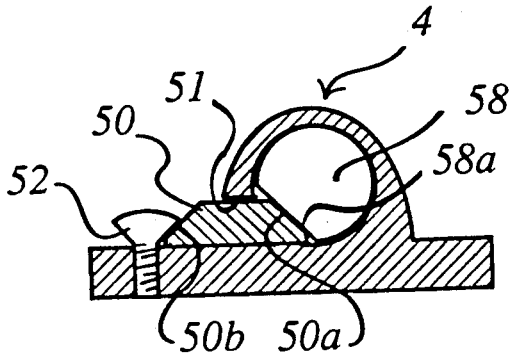
FIG. 8 is a cross sectional view depicting a key arrangement according to a fourth embodiment of the invention.

In FIG. 8 a fourth embodiment of the invention is depicted. The fourth embodiment is identical to the third in every respect except that it has a slot 51 formed in the boss portion, which penetrates to the interior of the bore 5. The spacers 58 in the bore 5 have a flattened side 58*a*.

A key member 50 is inserted into the slot 51 so that its beveled front edge 50*a* comes into engagement with the flat 58*a*. At its other side, the key 50 has a beveled edge, which is engaged by the bottom edge of a counter sink screw 52. Thus, tightening of the counter sink screw 52 tends to force the key member 50 into the slot 51 and increases the engaging pressure of the key bevel 50*a*, with the flat 58*a*. In this manner the key adjustably engages the spacer 58*a*, so as to prevent rotation thereof.

Figure 9:
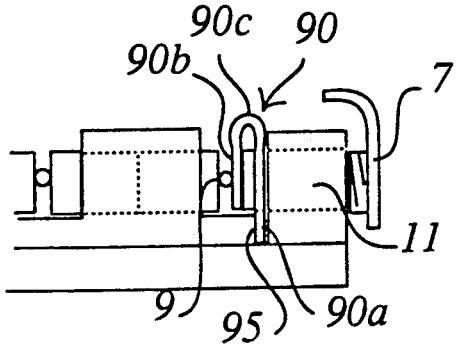
FIG. 9 is an enlarged partial front elevation view showing a detail of an end portion of the clamp according to a fifth embodiment of the invention, whereon retaining means is defined for retaining and preventing rotation of one of the spacers.

In another embodiment shown in FIG. 9, the boss portion is formed exactly, as in the FIG. 6 embodiment, with a groove 24. In this case the groove 24 receives the end of an inverted J-shaped retainer 95. The long side 95*a* of the retainer has a hole 90 through which the end of the screw 11 passes. The shorter side 95*b* of the retainer has no hole, and is engaged by the inner end of the screw 11.

In this embodiment, as the screw 11 is turned to move inwardly, the middle section bends so as to allow the short side 90*b* to be forced against the string 9 and, since the bottom of the J-shaped member is flush against the bottom of the slot 24, the retainer can't twist. Thus, as in the second embodiment, there is not any tendency for the first string to go out of tune due to twisting of the engaging surface.

Figure 10:
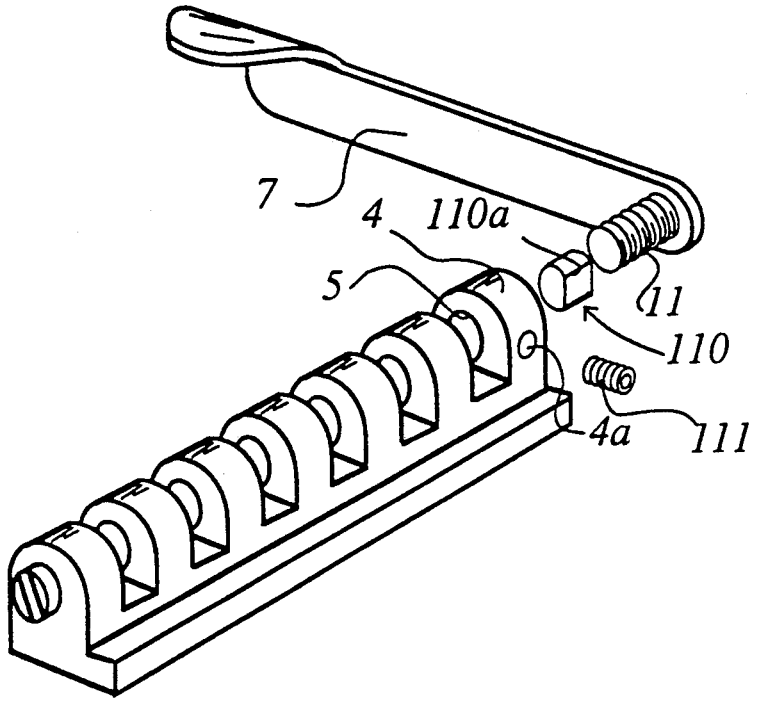
FIG. 10 is an enlarged partial front elevation view showing a detail of an end portion of the clamp according to a sixth embodiment of the invention, whereon retaining means is defined for preventing rotation of one of the spacers.

In another embodiment shown in FIG. 10, the boss portion 4 is essentially identical to that of the first embodiment, with the exception that a threaded bore 4*a* is formed at the end nearest the handle 7 at right angle to the axis of the bore 5. A set screw 111 is inserted into the bore 4*a*. The inner end of the set screw 111 engages a flat 110*a* formed on a side of the cylindrical end spacer 110, which is disposed in the bore 5. The set screw can be tightened to engage the flat 110*a*, so as to prevent the end spacer from rotating about its axis within the bore 5.

In this manner a simple inexpensive means is obtained by which the rotation of the end spacer is prevented, while still allowing the end spacer to slide along its axis within the bore 5.

It will be noted that in the embodiments of FIGS. 10 and 6, only the end spacer nearest the handle is restricted from rotation by means of the retainer 24 or the set screw 111. Embodiments are also easily conceivable however, wherein a retainer 24 or a set screw 111 is provided for each of the individual spacers to prevent them from rotating within the bore 5.

Figure 11:
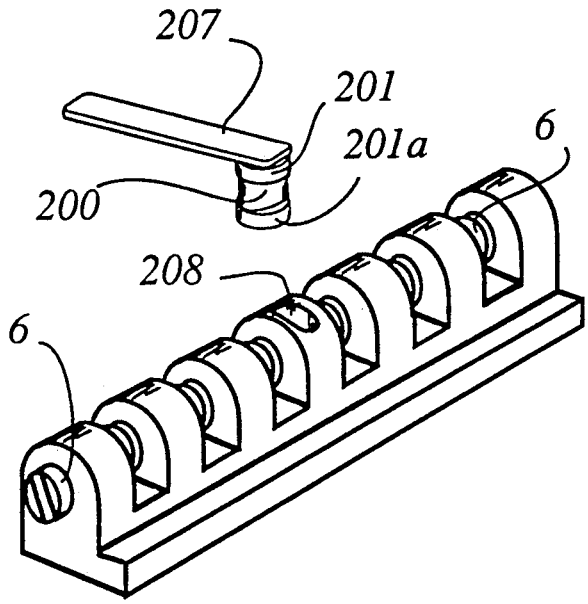
FIG. 11 is an enlarged perspective view showing details the spacer driving arrangement of the string clamp according to the seventh embodiment of the invention.

In a final embodiment shown in FIG. 11, instead of the screw 11 having the handle 7 as in the above embodiments, a cam is provided as the driving means for tightening the blocks of the clamp.

The main body of the clamp is formed essentially identically to that of the first embodiment, with the exception that a cam seating bore 208 is formed so as to intersect the bore 5, and set screws 6 are threaded into both ends of the bore 5, rather than at just one end.

The cam is formed on a cylindrical rod 201, which has a handle 207 by which it may be rotated. The rod 201 is inserted into the cam seating bore 208 formed in the top the boss 4. The cam seating bore 208 intersects the bore 5 at a substantially right angle. The ends of two of the spacers received within the bore 5 abut either side of the cam 200.

Beneath the cam 200, the rod 201 preferably comprises a cylindrical section 201*a* of the same diameter as the top section thereof. The cam surface is defined such that, when the handle 207 is rotated so as to project to the rear, the cam surface drives the spacers at either side thereof outwards, so as to decrease the gaps between the spacers at either side of the cam.

In this embodiment, if the cam seating bore 208 is formed so as to be perfectly cylindrical and to fit the rod 201 with no play, the gap width can be adjusted at either side of the cam independently, so that if desired, the clamping pressure for the bass and treble side strings need not be the same.

On the other hand since such perfection is in any case, difficult to obtain, it is also possible to form the cam seating bore 208 slightly oblong, in the longitudinal direction of the channel.

In cases where the cam seating bore is formed so as to be oblong, the advantage is obtained that the position of the cam along the axis of the channel "floats". Therefore, alignment of the strings with respect to the nut can be adjusted easily simply by tightening one of the set screws 6 while loosening the other.

What is more, since the cam has not tendency to rotate the spacers, no precautions against spacer rotation need to be taken.

In the depicted embodiment the cam 200 is disposed between the two center spacers however it may alternatively be disposed at one end of the bore 5 so as to drive the blocks in only one direction.

What is claimed is:

1. A clamp for clamping a plurality of strings of a musical instrument comprising:
   - a boss, said boss having a bore;
   - a plurality of slots, said slots being formed in said boss so as to expose portions of said bore;
   - a plurality of spacers, said plurality of spacers being disposed in said bore; and
   - tightening means, said tightening means being defined at one side of a spacer of said plurality of spacers and said tightening means being actuable for driving said spacers together so as to exert clamping pressure on a plurality of instrument strings disposed between said spacers.

2. A clamp as set forth in claim 1 wherein said bore is substantially cylindrical.

3. A clamp as set forth in claim 1 wherein said slots define general planes, said general planes defined by said slots intersecting said bore at substantially a right angle thereto.

4. A clamp as set forth in claim 1 wherein said tightening means is defined by a screw arranged at an axial end of said bore.

5. A clamp as set forth in claim 4 wherein a second screw is provided at an opposite end of said bore for defining a centering means for adjusting the general axial positions of said spacers within said bore.

6. A clamp as set forth in claim 4 wherein said screw engages a first spacer, said first spacer being restricted from rotation by said screw by means of a rotation restricting means, said rotation restricting means being comprised of a flat portion defined on said first spacer and a screw provided on said boss, said screw provided on said boss engaging said flat portion of said spacer for preventing rotation of said spacer.

7. A clamp as set forth in claim 4 wherein said screw engages a first spacer, said first spacer being restricted from rotation by said screw by means of a rotation restricting means, said rotation restricting means being comprised of a flat portion defined on said first spacer and a retaining means provided on said boss, said retaining means provided on said boss comprising a hole, the cross-section of said hole corresponding to the cross section of said spacer at a portion of said spacer at which said flat portion of said spacer is formed for receiving an end of said spacer on which said flat portion is formed for preventing rotation of said spacer with respect to said boss portion.

8. A clamp as set forth in claim 4 wherein said screw engages a first spacer, said first spacer being restricted from rotation by said screw by means of a rotation restricting means, said rotation restricting means being comprised of a flexible member, said flexible member being disposed between said screw and a first string of said plurality of strings, a portion said flexible member being rigidly seated on said boss so as to be non-rotable with respect thereto about the axis of said bore.

9. A clamp as set forth in claim 1 wherein said tightening means is defined by a cam arranged at a portion of said bore.

10. A clamp as set forth in claim 9 wherein said cam is arranged at an axial central portion of said bore.

11. A clamp as set forth in claim 9 wherein said cam is rotatable about an axis defined at a right angle to said bore.

12. A clamp as set forth in claim 11 wherein said cam is arranged between two of said spacers for driving said spacers in opposite axial directions of said bore in response to rotation of said cam.

13. A clamp as set forth in claim 12 wherein said cam is movable in the longitudinal direction of said bore.

14. A clamp for clamping the strings of a musical instrument comprising:
   - a spacer receiving means having a cylindrical bore for receiving a plurality of spacers;
   - a plurality of spacers between which said strings are disposed said spacers being substantially cylindrical and said spacers being disposed within said cylindrical bore; and
   - a retainer member, said retainer member being formed so as to engage a spacer of said plurality of spacers so as to define a means for preventing rotation of said spacer with respect to said spacer receiving means.

* * * * *